US005971197A

United States Patent [19]

Everette et al.

[11] Patent Number: 5,971,197

[45] **Date of Patent: *Oct. 26, 1999**

[54] MULTI-CHAMBERED CONTAINER

[75] Inventors: C. Joseph Everette, Marietta; Charles M. Brandt, Lithia Springs, both of Ga.; Richard G. Kraft, Joliet, Ill.

[73] Assignee: Crown Cork & Seal Technologies Corporation, Alsip, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/808,184

[22] Filed: Feb. 28, 1997

[51] Int. Cl.[6] ..... B65D 1/04

[52] U.S. Cl. ..... 220/555; 220/500; 215/6

[58] Field of Search ..... 220/555, 500, 220/506, 516, 517; 215/6

[56] References Cited

U.S. PATENT DOCUMENTS

| | | | |
|---|---|---|---|
| D. 287,571 | 1/1987 | Hutchins | D9/313 |
| D. 288,526 | 3/1987 | Parad | D9/341 |
| D. 290,225 | 6/1987 | Carlson | D9/341 |
| 3,076,573 | 2/1963 | Thomas | 215/6 |
| 3,394,209 | 7/1968 | Cheney | 425/526 |
| 3,394,861 | 7/1968 | Truax | 220/555 |
| 3,474,927 | 10/1969 | Bowles | 215/6 |
| 3,535,411 | 10/1970 | Bowles et al. | 425/525 |
| 3,724,987 | 4/1973 | Schiemann | 425/526 |
| 4,147,270 | 4/1979 | Brandon, Jr. et al. | 220/555 |
| 4,166,833 | 9/1979 | Schurman | 425/525 |
| 4,423,000 | 12/1983 | Teraoka | 264/526 |
| 4,534,509 | 8/1985 | Holzner | 239/34 |
| 4,798,288 | 1/1989 | Holzner | 206/222 |
| 4,884,703 | 12/1989 | O'Meara | 215/6 |
| 4,964,539 | 10/1990 | Mueller | 222/94 |
| 4,998,671 | 3/1991 | Leifheit | 239/44 |
| 5,088,627 | 2/1992 | Musel | 222/145 |
| 5,154,917 | 10/1992 | Ibrahim et al. | 424/7.1 |
| 5,232,108 | 8/1993 | Nakamura | 425/525 |
| 5,252,312 | 10/1993 | Gentile et al. | 424/44 |
| 5,289,950 | 3/1994 | Gentile | 222/142.3 |
| 5,353,927 | 10/1994 | Stupar et al. | 206/219 |
| 5,363,990 | 11/1994 | Fillmore | 222/135 |
| 5,398,828 | 3/1995 | Valyi | 220/555 |
| 5,407,278 | 4/1995 | Beer | 383/38 |
| 5,447,236 | 9/1995 | Perry et al. | 206/541 |
| 5,482,170 | 1/1996 | Semersky et al. | 220/555 |

FOREIGN PATENT DOCUMENTS

| | | |
|---|---|---|
| 2 039 579 A1 | 4/1991 | Canada . |
| 59-232828 | 12/1984 | Japan . |
| 2 230 756 | 10/1990 | United Kingdom . |

OTHER PUBLICATIONS

Figures 1 through 6 depicting a prior art container (Figs 4–6 depict a top view of the container after removal of the trigger sprayer shown in Figure 1).

*Primary Examiner*—Joseph M. Moy
*Attorney, Agent, or Firm*—Woodcock Washburn Kurtz Mackiewicz & Norris LLP

[57] ABSTRACT

A plastic container that has more than one chamber and that is constructed so as to be stiffer than conventional molded multi-chambered containers includes a bottom wall, a neck, and a main body that has defined therein a first pinched-in area and a second pinched-in area that extends inwardly toward and is joined to the first pinched-in area so as to define separate compartments. The first end wall portion is laterally offset from the second end wall portion, so that the flexibility of the main body about the joint of the first and second wall portions is minimized. As a result, the container is less likely to need supplemental reinforcement against flexure.

16 Claims, 2 Drawing Sheets

MULTI-CHAMBERED CONTAINER

BACKGROUND OF THE INVENTION

1. Field of the Invention

This invention relates broadly to the field of containers, such as the plastic containers that are commonly used for packaging solid and liquid detergents, cleaners and foodstuffs. More specifically, this invention pertains to an improved dual chambered container that is lightweight, strong and inexpensive to produce.

2. Description of the Prior Art

Plastic containers are in wide use throughout the United States and the world for packaging virtually every type of liquid and solid material, for both commercial and household applications. The detergent industry, for example, has turned increasingly to plastic containers for packaging such products as bleach, soap, sanitizing agents, and polishes. Plastic is relatively inexpensive, will not shatter when dropped, and is recyclable.

Some products are best packaged, for reasons of both marketability and convenience, together with one or more other products in a container that has more than one chamber, or in a pair of containers that are joined together in some manner. With respect to the latter mentioned option, packaging is known that includes two separate containers that are joined together by a common closure having two openings. U.S. Pat. Nos. 5,289,950 and 5,252,312 disclose packaging of this type. These type of containers are relatively expensive to make because of the complexity of the manufacturing process, require a relatively large amount of plastic material per volume of product that is being packaged, and are undesirable to the extent that the container's design leaves open the possibility of separation of the individual containers during use.

Other known processes for producing a plastic container having more than one chamber include those where a container is first molded as a single chambered container, and then heat sealed into separate compartments in a subsequent reforming step. Because of this second reforming and heating step, the process is more time consuming and expensive than a one-step forming process. In addition, because the compartments that are defined by the heat sealing step tend to be joined together only by a thin web of material, the resulting product tends to be overly flexible and requires reinforcement by and external device such as a special closure, a base cup or an adhesive label that is positioned to prevent relative movement between the formed compartments.

A need exists in this area of technology for an improved multi-chambered container that is lightweight, relatively inexpensive to produce, and that requires less external reinforcement against flexure than conventional multi-chambered containers do.

SUMMARY OF THE INVENTION

Accordingly, it is an object of this invention to provide an improved multi-chambered container that is lightweight, relatively inexpensive to produce, and that requires less external reinforcement against flexure than conventional multi-chambered containers do.

In order to achieve the above and other objects of the invention, a plastic container that has more than one chamber and that is constructed so as to be stiffer than conventional molded multi-chambered containers includes, according to a first aspect of the invention, a bottom wall; a neck; and a main body, the main body having a sidewall that is connected to the bottom wall and the neck, said wherein the sidewall defines: a first pinched-in area that includes first and second wall portions that extend inwardly toward an interior of the main body, and a first end wall portion connecting the first and second wall portions; and a second pinched-in area that includes third and fourth wall portions that extend inwardly toward an interior of the main body, and a second end wall portion connecting the third and fourth wall portions, the first end wall portion being joined to said second end wall portion so as to define separate compartments within said main body; and wherein the first end wall portion is laterally offset from the second end wall portion, whereby the flexibility of the main body about the joint of the first and second wall portions is minimized.

A plastic container that has more than one chamber and that is constructed so as to be stiffer than conventional molded multi-chambered containers includes, according to a second aspect of the invention, a bottom wall; a neck; and a main body having a first pinched-in area and a second pinched-in area that extends inwardly toward and is joined to the first pinched-in area so as to define separate compartments within the main body; and wherein the first end wall portion is laterally offset from the second end wall portion, whereby the flexibility of the main body about the joint of the first and second wall portions is minimized.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
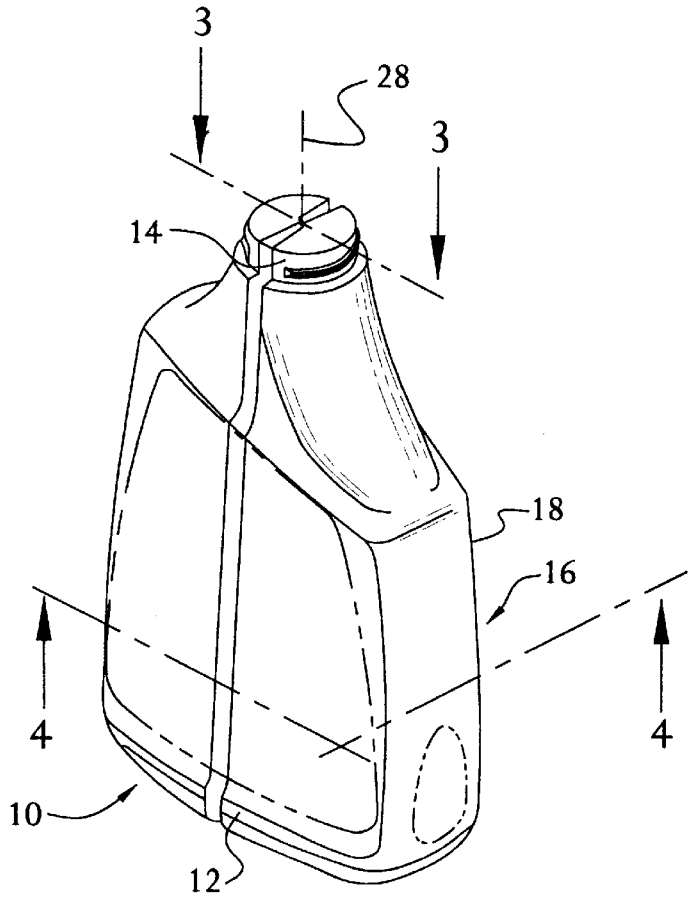
FIG. 1 is a perspective view of an improved plastic container that is constructed according to a preferred embodiment of the invention.

Referring now to the drawings, wherein like reference numerals designate corresponding structure throughout the views, and referring in particular to FIGS. 1–4, an improved plastic container 10 that has more than one chamber and that is constructed so as to be stiffer than conventional multi-chambered containers includes a bottom wall 12, a neck 14 and a main body 16. As may be seen in FIGS. 1–4, the main body 16 includes a sidewall 18 that has defined therein a first pinched-in area 20 and a second pinched-in area 22 that extends inwardly toward and is joined to the first pinched-in area 20 so as to define separate compartments 42, 44 within the main body 16. In the description that is given below, the container 10 extends in three different axes; a depth axis 24, shown in FIGS. 2 and 4, along which the depth of the container 10 can be measured; a width axis 26 also shown in FIGS. 2 and 4, along which the width of the container 10 can be measured; and a height axis 28, shown in FIG. 1, along which the height of the plastic container 10 can be measured, and that is coincidence with the longitudinal axis of the plastic container 10.

Figure 3:
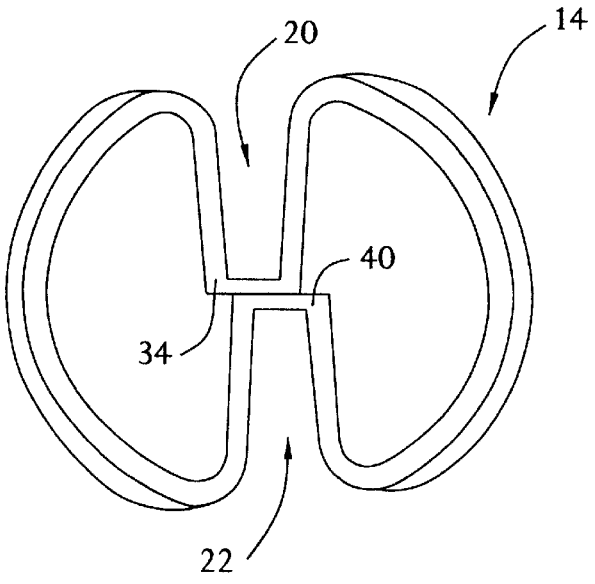
FIG. 3 is a cross-sectional view taken along lines 3—3 in FIG. 1.
Figure 4:
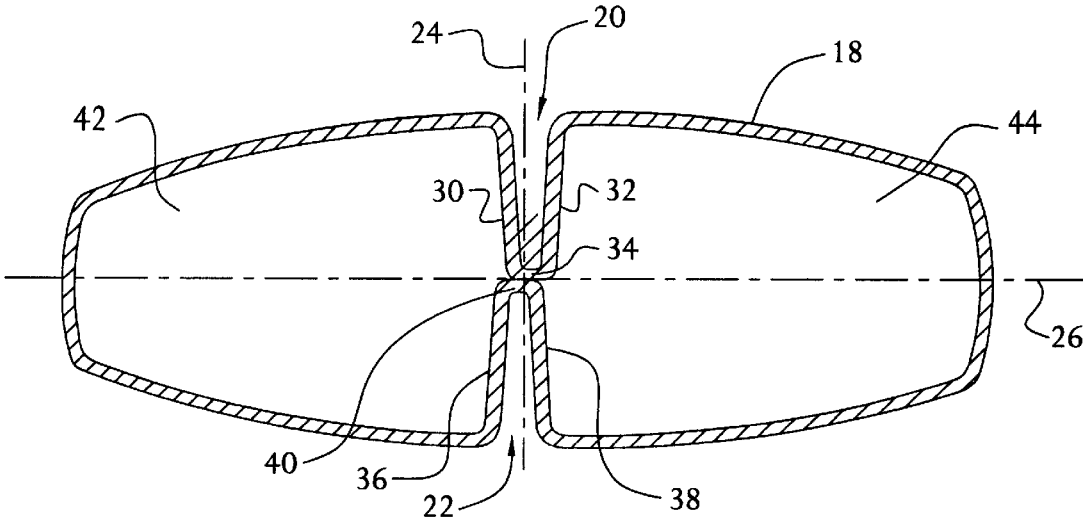
FIG. 4 is a cross-sectional view taken along lines 4—4 in FIG. 1.

As may best be seen in FIG. 4, the first pinched-in area 20 is characterized by a first wall portion 30 and a second wall portion 32, both of which extend inwardly (i.e., in a direction that is principally along the depth axis 24), toward an interior of the main body 16. A first end wall portion 34 connects the inward most extent of the first and second wall portions 30, 32 as may best be seen in FIGS. 3 and 4. Similarly, the second pinched-in area 22 includes a third wall portion 36 and a fourth wall portion 38, both of which extend inwardly along the depth axis 24 into the interior of the main body 16, and which have their inward most ends connected by a second end wall portion 40, as can be seen in FIGS. 3 and 4. The first end wall portion 34 is joined to the second end wall portion 40 so as to define the first and second compartments 42, 44.

Figure 2:
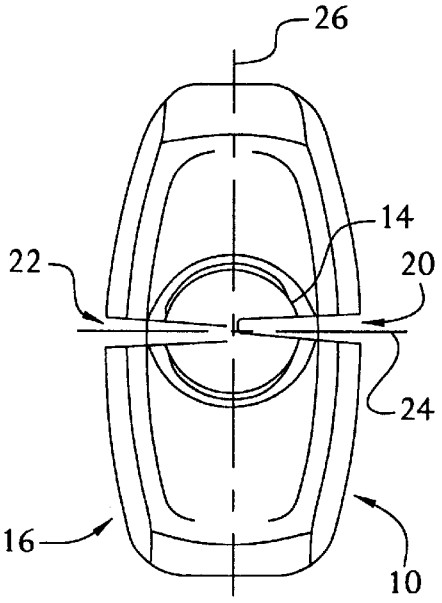
FIG. 2 is a top elevational view of the container that is depicted in FIG. 1.

One important aspect of the invention involves the fact that the first end wall portion 34 is slightly offset from the second end wall portion 40 (i.e., in the direction of the width axis 26, as may best be seen in FIGS. 2, 3 and 4) so as to minimize the potential for flexure of the container 10, or specifically the main body 16, at the joint that is formed between the first and second end wall portions 34, 40.

It should be understood that alternative structure could be used to minimize the potential for flexure of the container 10, and that such alternatives may equally be within the scope of the invention. For example, the two pinched-in portions could be offset to a degree that it is their sidewall portions that are joined, instead of the end walls. As an alternative to the offset structure, one endwall could be made larger than the other end wall.

Figure 5:
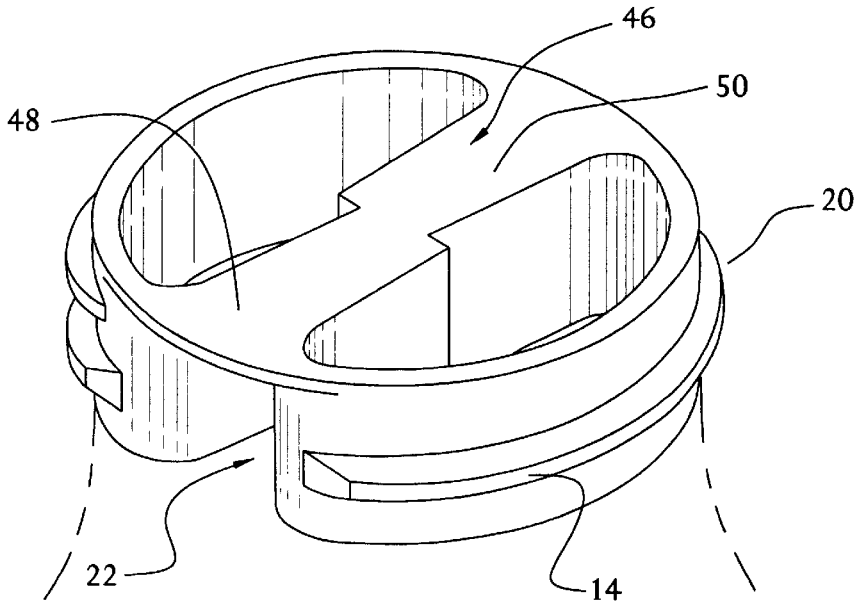
FIG. 5 is a fragmentary view of an upper portion of the neck of the container depicted in FIGS. 1–4.

As may be seen in FIGS. 1 and 3, the container 10 is constructed so that the first and second pinched-in areas 20, 22 extends into the neck 14 of the container 10. Another important aspect of the invention involves the fact that structure is provided for reinforcing the neck 14 against collapse as a result of the pinched-in areas 20, 22 when radial compressive pressure is applied to the neck 14 such as will occur when a closure or a spray cap is fitted onto the neck 14. In the preferred embodiment of the invention, shown in FIG. 5, this structure for reinforcing the neck against collapse involves the presence of a web 46 positioned near the top of the neck 14, which joins together and prevents flexure of at least one first pinched-in area 20 and the second pinched-in area 22. In the most preferred embodiment of the invention, the web 46 includes a first web portion 48 and a coextensive second web portion 50, which together prevent flexure of both the first pinched-in area 20 and the second pinched-in area 22.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic container that has more than one chamber and that is constructed so as to be stiffer than conventional molded multi-chambered containers, comprising:

a bottom wall;

a neck; and a main body, said main body having a sidewall that is connected to said bottom wall and said neck, said wherein said sidewall defines:

a first pinched-in area that includes first and second wall portions that extend inwardly toward an interior of the main body, and a first end wall portion connecting the first and second wall portions; and a second pinched-in area that includes third and fourth wall portions that extend inwardly toward an interior of the main body, and a second end wall portion connecting the third and fourth wall portions, said first end wall portion being joined to said second end wall portion so as to define separate compartments within said main body; and wherein said first end wall portion is laterally offset from said second end wall portion, whereby the flexibility of the main body about the joint of said first and second wall portions is minimized.

2. A container according to claim 1, wherein said first end wall portion is heat fused to said second end wall portion.

3. A container according to claim 1, wherein said first and second pinched-in areas further extend into said neck.

4. A container according to claim 3, further comprising means for reinforcing said neck against collapse as a result of said pinched-in areas when radial compressive pressure is applied, such as will occur when a closure is fitted onto said neck.

5. A container according to claim 4, wherein said reinforcing means comprises a web, positioned near a top of said neck, joining together and preventing flexure of at least one of said first pinched-in area and said second pinched-in area.

6. A container according to claim 5, wherein said web is positioned substantially within a plane that is perpendicular to a longitudinal axis of the neck.

7. A container according to claim 4, wherein said reinforcing means comprises a web, positioned near a top of said neck, joining together and preventing flexure of said first pinched-in area and said second pinched-in area.

8. A container according to claim 7, wherein said web is positioned substantially within a plane that is perpendicular to a longitudinal axis of the neck.

9. A plastic container that has more than one chamber and that is constructed so as to be stiffer than conventional molded multi-chambered containers, comprising:

a bottom wall;

a neck; and a main body having a first pinched-in area and a second pinched-in area that extends inwardly toward and is joined to the first pinched-in area so as to define separate compartments within said main body; and wherein said first pinched-in area is laterally offset from said second pinched-in area, whereby the flexibility of the main body about the joint of said first and second pinched-in areas is minimized.

10. A container according to claim 9, wherein said first pinched-in area is heat fused to said second pinched-in area.

11. A container according to claim 9, wherein said first and second pinched-in areas further extend into said neck.

12. A container according to claim 11, further comprising means for reinforcing said neck against collapse as a result of said pinched-in areas when radial compressive pressure is applied, such as will occur when a closure is fitted onto said neck.

13. A container according to claim 12, wherein said reinforcing means comprises a web, positioned near a top of said neck, joining together and preventing flexure of at least one of said first pinched-in area and said second pinched-in area.

14. A container according to claim 13, wherein said web is positioned substantially within a plane that is perpendicular to a longitudinal axis of the neck.

15. A container according to claim 12, wherein said reinforcing means comprises a web, positioned near a top of said neck, joining together and preventing flexure of said first pinched-in area and said second pinched-in area.

16. A container according to claim 15, wherein said web is positioned substantially within a plane that is perpendicular to a longitudinal axis of the neck.

* * * * *

UNITED STATES PATENT AND TRADEMARK OFFICE

CERTIFICATE OF CORRECTION

PATENT NO. : 5,971,197
DATED : October 26, 1999
INVENTOR(S) : C. Joseph Everette et al.

It is certified that error appears in the above-identified patent and that said Letters Patent is hereby corrected as shown below:

Title page,
Item [56], References Cited, U.S. PATENT DOCUMENTS, insert:

| | | | |
|---|---|---|---|
| -- | 2,661,870 | 12/1953 | Heunergardt……222/129 |
| | 2,661,871 | 12/1953 | Heunergardt……..222/129 |
| | D.189,938 | 3/1961 | Heintze……D58/6 |
| | D.190,101 | 4/1961 | Mangini……D58/8 |
| | 3,197,071 | 7/1965 | Kusler…… 222/94 |
| | 3,337,073 | 8/1967 | Angelo……215/6 |
| | D.214,549 | 7/1969 | Ledewitz……..D9/18 |
| | 3,581,940 | 6/1971 | Cella……222/94 |
| | 3,705,661 | 12/1972 | Davis……215/6 |
| | 3,729,553 | 4/1973 | Gold…..……424/44 |
| | 3,866,800 | 2/1975 | Schmitt……222/94 |
| | D.244,992 | 7/1977 | Van der Veken……D9/167 |
| | D.263,118 | 2/1982 | Weckman……...D9/341 |
| | D.280,599 | 9/1985 | Green……D9/341 -- |

FOREIGN PATENT DOCUMENTS:
Delete "59-232828" and insert -- 59-232828A -- therefor;
Delete "2 230 756" and insert -- 2 230 756A -- therefor;

Column 1,
Line 46, delete "by and external" and insert -- by an external -- therefor.

Signed and Sealed this

Thirteenth Day of August, 2002

*Attest:*

*Attesting Officer*

JAMES E. ROGAN
*Director of the United States Patent and Trademark Office*